United States Patent [19]

McLuen

[11] Patent Number: 4,487,108

[45] Date of Patent: Dec. 11, 1984

[54] VARIABLE DISPLACEMENT PUMP/MOTOR

[76] Inventor: Carl T. McLuen, 26930 S.E. 216th St., Maple Valley, Wash. 98038

[21] Appl. No.: 422,362

[22] Filed: Sep. 23, 1982

[51] Int. Cl.[3] ..... F01B 13/04; F04B 1/30

[52] U.S. Cl. ..... 91/504; 92/12.2

[58] Field of Search ..... 91/501, 504, 505, 488; 417/222; 92/12.2

[56] References Cited

U.S. PATENT DOCUMENTS

| | | | |
|---|---|---|---|
| 1,840,866 | 1/1932 | Rayburn | 91/506 |
| 2,691,350 | 10/1954 | Greer | 91/501 |
| 2,718,758 | 9/1955 | Minshall et al. | 91/507 |
| 3,186,352 | 6/1965 | Anderson | 91/507 |
| 3,370,511 | 2/1968 | Gibbs et al. | 91/501 |
| 3,602,105 | 8/1971 | Slushes | 91/501 |

FOREIGN PATENT DOCUMENTS

| | | | |
|---|---|---|---|
| 528501 | 7/1956 | Canada | 91/501 |
| 2207658 | 8/1973 | Fed. Rep. of Germany | 91/505 |
| 622787 | 12/1959 | Italy | 91/501 |
| 563335 | 8/1944 | United Kingdom | 91/501 |

*Primary Examiner*—William L. Freeh

*Attorney, Agent, or Firm*—Delbert J. Barnard

[57] ABSTRACT

A pair of bearing support members (48, 50) are located within opposite end portions (12, 14) of an elongated housing (10). Piston drive rings (58, 68) are mounted for rotation on oblique inner end portions of the bearing support members (48, 50). A cylinder block (44) is mounted for rotation within the housing (10) between the bearing support members (48, 50). The cylinder block (44) includes a plurality of axial bores (46). A pair of pistons (70, 72) reciprocate within each bore (46). Each piston (70, 72) is connected to the piston drive ring (58, 68) at its end of the housing (10) by means of a connector rod (74, 76). An inlet scroll (206 or 208) and an outlet scroll (206 or 208) communicate with center regions of the cylinder bores (46). A system of drive shafts (230, 238) and gears (232, 234, 236, 240) rotate the bearing support members (58, 68) in opposite directions, to change the relative positioning of the oblique piston drive rings (58, 68) relative to each other, to in this manner, change the stroke length of the mechanism and/or the direction of fluid flow through the mechanism.

11 Claims, 9 Drawing Figures

VARIABLE DISPLACEMENT PUMP/MOTOR

DESCRIPTION

1. Technical Field

The present invention relates to variable displacement fluid pumps and motors, and in particular to the provision of an improved variable displacement fluid mechanism, of the axial piston type, operable as either a pump or a motor, in which the displacement is easily changed by a simple counterrotation of two bearing support members located within opposite end sections of the mechanism's housing.

2. Background Art

The present invention relates to improvements in the general class of hydraulic pumps and motors which is shown by the following U.S. Pat. Nos. 1,287,026, granted Dec. 10, 1918, to Renold Janney; 1,634,867, granted July 5, 1927, to Romualdo Borletti; 1,794,575, granted Mar. 3, 1931, to Senatore Bouletti; 2,151,415, granted Mar. 21, 1939, to David S. Bennetch; 2,465,638, granted Mar. 29, 1949, to Samuel B. Eckert; 3,076,345, granted Feb. 5, 1963, to Jacques A. Leclercq; 3,135,166, granted June 2, 1964, to Alexander R. Born; 3,139,037, granted June 30, 1964, to Tadeusz Budzich; 3,246,577, granted Apr. 19, 1966, to Donald J. MacIntosh; 2,633,802, granted Apr. 7, 1953, to Authur R. Parilla and Anthony Peters and 3,678,807, granted July 25, 1972, to Herman E. Papst.

DISCLOSURE OF THE INVENTION

In basic form, a pump or motor constructed according to the present invention comprises a rotatable cylinder block. The cylinder block includes a plurality of axial cylinder bores arranged in a ring surrounding the axis of rotation of the cylinder block. Two pistons are received within each cylinder bore. A connector rod connects to each piston and extends axially outwardly from its cylinder bore. The outer end of each connector rod is connected to a piston drive ring.

In accordance with the present invention, each piston drive ring is supported for rotation on an oblique inner end portion of a support member. The two support members are mounted for rotation about axis coinciding with the axis of rotation of the cylinder block. Mechanism is provided for rotating the two support members in opposite directions, for changing the relative positions of the oblique supports relative to each other. This provides a quite simple and effective way of varying the displacement of the piston/motor.

Further aspects of the invention are set forth in the detailed description of two preferred embodiments, and by the appended claims.

BRIEF DESCRIPTION OF THE DRAWINGS

Referring to the accompanying drawings, which are for illustrative purposes.

BEST MODES FOR CARRYING OUT THE INVENTION

Figure 1:
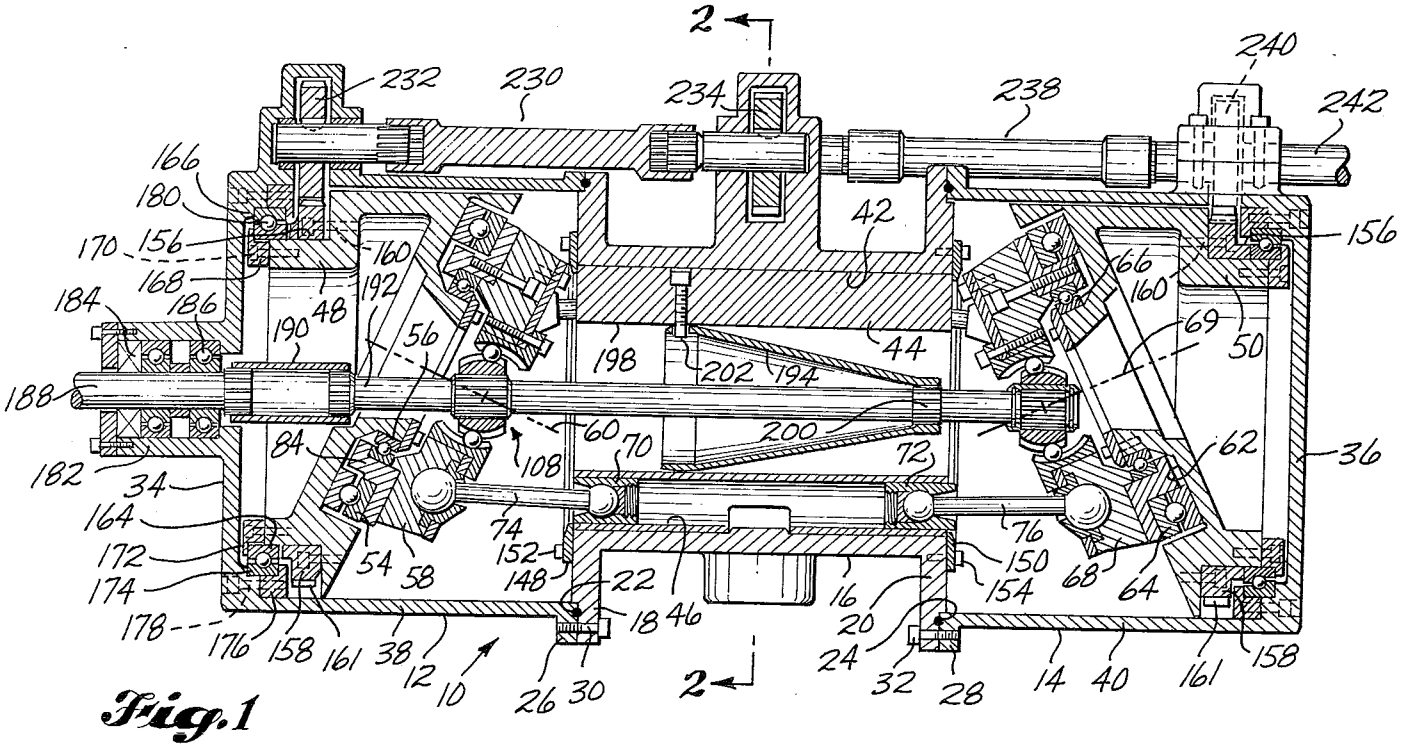
FIG. 1 is a longitudinal sectional view taken through a first embodiment of the invention, with some parts shown in side elevation.

Referring to FIG. 1, in preferred form, the mechanism comprises a three part housing 10 composed of two end sections 12, 14 and a center section 16.

The center section 16 may include radial flanges 18, 20 at its opposite ends, each of which is machined to include a peripheral groove 22, 24 on its outer face, for receiving a flange 26, 28 formed at the inner end of an end section 12, 14. Bolts 30 may connect the flanges 18, 26 together and bolts 32 may connect the flanges 20, 28 together.

Each housing end section 12, 14 includes a radial outer end wall 34, 36 and a cylindrical side wall 38, 40. In the illustrated embodiment, end wall 36 is closed whereas end wall 34 includes a central opening for accommodating a drive shaft, as will hereinafter be described in greater detail.

The center section 16 of housing 10 includes a large diameter axial bore 42. An axially elongated cylinder block 44 is snugly received within the bore 42.

Cylinder block 44 is formed to include a plurality of axially extending cylinder bores 46, the exact number of which is a variable. The illustrated embodiment includes eight cylinder bores 46 and they are arranged in a ring around the axis of rotation of the cylinder block 44.

A bearing support member 48, 50 is housed within each end section 12, 14 of the housing 10. Each bearing support member 48, 50 is mounted for a controlled amount of rotation about an axis coincident with the axis of rotation of the cylinder block 44. Each bearing support member 48, 50 includes an inner end portion which is set at an oblique angle with respect to the axis of rotation of the cylinder block 44. The angled inner end portion of bearing support 48 is grooved at 52 and within said groove supports a large antifriction bearing 54 and a small antifriction bearing 56. Bearing 54, 56 support a piston drive ring 58 for rotation relative to the bearing support member 48, about an axis 60 which extends perpendicular to the general plane of the bearings 54, 56.

In similar fashion, the bearing support member 50 comprises an angled inner end which includes a groove 62 in which bearings 64, 66 are received. Bearings 64, 66 mount a second piston drive ring 68 for rotation relative to bearing support member 50, about an axis 69 which is perpendicular to the support plane of the bearings 64, 66.

Each cylinder bore 46 includes a pair of pistons 70, 72. The pistons 70 are connected to the piston drive ring 58 by means of connector rods 74. In like fashion, the pistons 72 are connected to piston drive ring 68 by connector rods 76. The connector rods 74, 76 have ball and socket type universal joints at each of their ends.

A drive shaft is connected to the cylinder block 44 and to both of the piston drive rings 58, 68. Thus, during operation of the mechanism, the drive shaft, the cylinder block 44 and the piston drive rings 58, 68 all rotate together. The housing parts 12, 14, 16 and the bearing support members 48, 50 are stationary, i.e. they do not rotate.

The piston drive rings 58, 68 are of like construction and are supported and connected in the same way to their respective bearing supports 48, 50. Accordingly, only piston drive ring 58, and its associated structure, will be described in detail.

Figure 3:
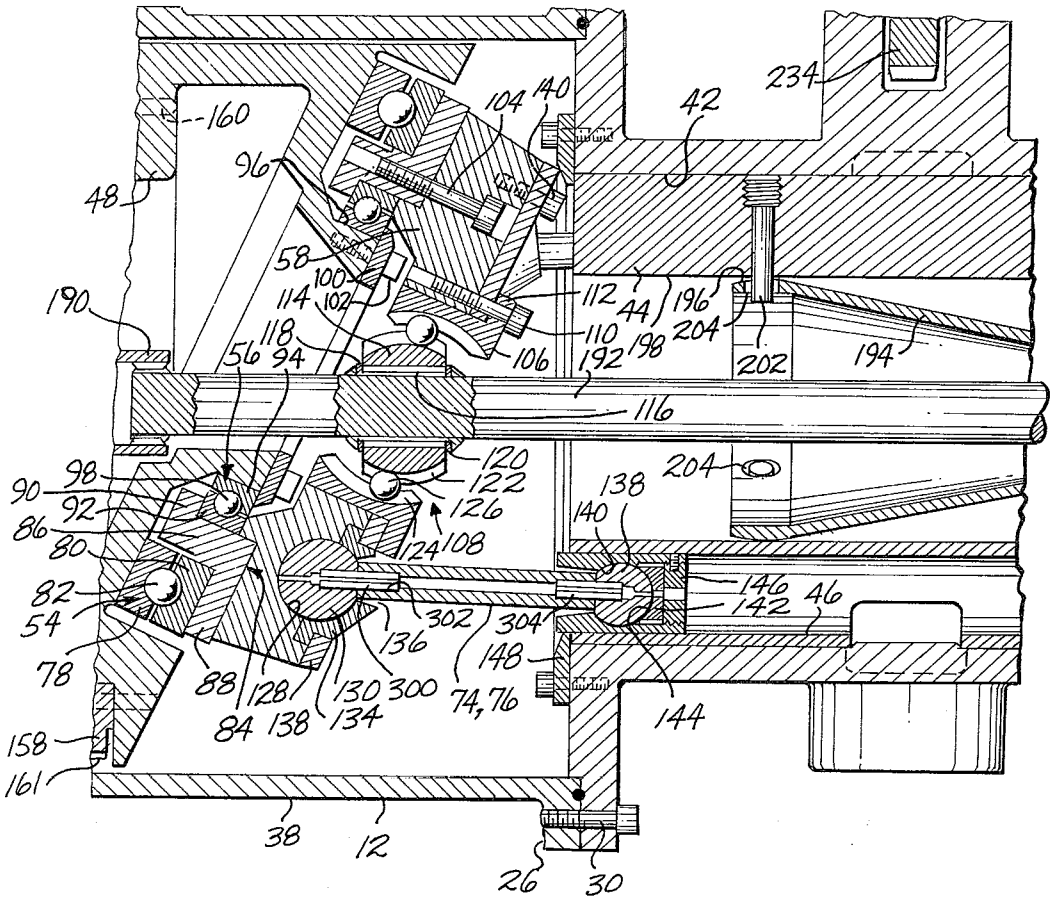
FIG. 3 is an enlarged scale longitudinal sectional view of a piston rod and piston assembly and a piston drive ring assembly.

Referring to FIG. 3, bearing 54 includes a fixed race 78, a rotating race 80 and antifriction ball elements 82 between the races. An annular bearing ring 84 includes a cylindrical body 86 and a pair of oppositely directed radial flanges 88, 90. Flange 88 and body 86 form a radially outwardly directed nook in which the rotating race 80 is received. Body 86 and flange 90 form a radially inwardly directed nook which receives the rotating race 92 of bearing 56. The fixed race 94 of bearing 56 snuggly surrounds a cylindrical boss 96 formed on bearing support 50 inwardly of the groove 52. A plurality of ball type antifriction elements 98 are located between the bearing races 92, 94. A retainer ring 100 is bolted to bearing support 50 by means of a plurality of bolts 102. Retainer ring 100 includes an outer edge portion which overlaps the fixed race 94 of bearing 56. Piston drive ring 58 is secured to bearing ring 84 by means of a plurality of bolts 104, the head portions of which are countersunk into the piston drive ring 58. The bearing 56, bearing ring 84 and bearing 54 interlock, so retainer ring 100 holds them all in place.

Piston drive ring 58 includes an open center in which the outer member 106 of an universal joint 108 is received. Member 106 is bolted to and rotates with piston drive ring 58, by means of a ring of bolts 110 which extend through openings in a flange portion 112 of member 106 and thread into threaded sockets formed in piston drive ring 58. Universal joint 108 also includes an inner member 114 which is spline connected to the drive shaft at 116, between a pair of retainer rings 118, 120. Member 114 includes convexly curved axial grooves 122 and member 106 includes complementary axial grooves 124 of concave curvature. Ball elements 126 are retained by and aligned by an annular perforated ring (not shown) between the complementary grooves 122, 124 and provide an interlock for transfering rotational drive from one of members 106, 114 to the other.

The particular universal joint 108 that has been shown and described is a well known constant velocity type.

Piston drive ring 58 also includes a plurality of sockets 128, each of which received a ball member 130 connected to the outer end of an associated connector rod 74. The base of socket 128 is machined into piston drive ring 58 and the socket is completed by a cover member 134 which includes an opening 136 through which the rods 74 extend. Covers 134 are held in place by a retainer plate 138 which is secured to piston drive ring 58 by means of a ring of bolts 140.

The inner end of each connector rod 74 includes a ball element 138 which is received within a complementary socket formed inside of a piston 70. The pistons 70, 72 are identical in construction, so only pistons 70 will be described.

In preferred form, each piston 70 (FIG. 1) is elongated, has a cylindrical outer shape and is sized to be snugly received within its bore 46 within the cylinder block 44. A center opening extends axially through the piston 70 and includes a seat or socket surface 140 in mating engagement with the ball 138. An insert 142 carrying a socket surface 144 is positioned outwardly of ball 138. A plug 146 closes the inner end of the axial opening and completes the piston face at the inner end of the piston 70, 72.

As earlier mentioned, cylinder block 44 rotates within the bore 42. A retainer ring 148, 150 is located at each end of cylinder block 44. Each retainer ring 148, 150 is secured to its end of housing portion 16 by means of a ring of bolts 152, 154. As shown in FIG. 1, the radial inner edge portion of each retainer ring 148, 150 overlaps a portion of the adjacent end of the cylinder block 44.

Each bearing support 48, 50 is mounted for rotation within its end section 12, 14 of the housing 10 in the same manner. Each bearing support 48, 50 includes a circumferential groove 156 at its outer end in which a gear ring 158 is received. The gear ring 158 is secured to its bearing support 48, 50 by means of a ring of bolts 160. Each ring gear 158 includes radially outwardly directed gear teeth 161. The radial dimension or depth of the gear ring 158 is less than the radial depth of the groove 156. Thus, the gear teeth 161 are wholly within the groove 156. At its outer end, each gear ring 158 makes abutting contact with a rotating, inner race 164 of a bearing 166. A retainer ring 168 is secured to bearing support 48, 50, such as by means of a ring of bolts 170. Retainer ring 168 includes a flange 172 which overlaps bearing race 164 and clamps it in place between retainer ring 168 and ring gear 158. The outer race 174 of combination bearing 166 is clamped to a portion of the related housing section 12, 14 by means of a retainer ring 176 and a plurality of bolts 178. Antifriction elements 180, which carry both radial and axial forces, are located between the two races 164, 174.

End wall 34 of housing part 12 may include a cylindrical bearing box 182 in which a pair of axially spaced apart shaft bearings 184, 186 are received. An input/output portion 188 of the drive shaft is supported for rotation by the bearings 184, 186. The inner end of shaft portion 188 is spline connected to a tubular coupling 190. The inner end of tubular coupling 190 is spline connected to an internal section 192 of the drive shaft. As earlier described, the inner members 114 of the universal joints are spline connected to shaft member 192. In preferred form, cylinder block 44 is connected to shaft portion 192 by means of a conical coupler 194, the outer end of which includes a ball surface 196 which is snugly received within a cylindrical opening 198 extending axially through cylinder block 44. The small end of coupler 194 is spline connected to shaft member 192, at 200. The larger diameter end of coupler 194 is loosely connected to cylinder block 44 by means of one or more drive pins 202 which have inner end portions which project radially inwardly from cylinder block 44 into elongated openings 204 formed in the large diameter end of coupler 194. This manner of coupling between the drive shaft and the cylinder block 44 accommodates any minor misalignment between the shaft member 192 and the cylinder block 44.

Figure 2:
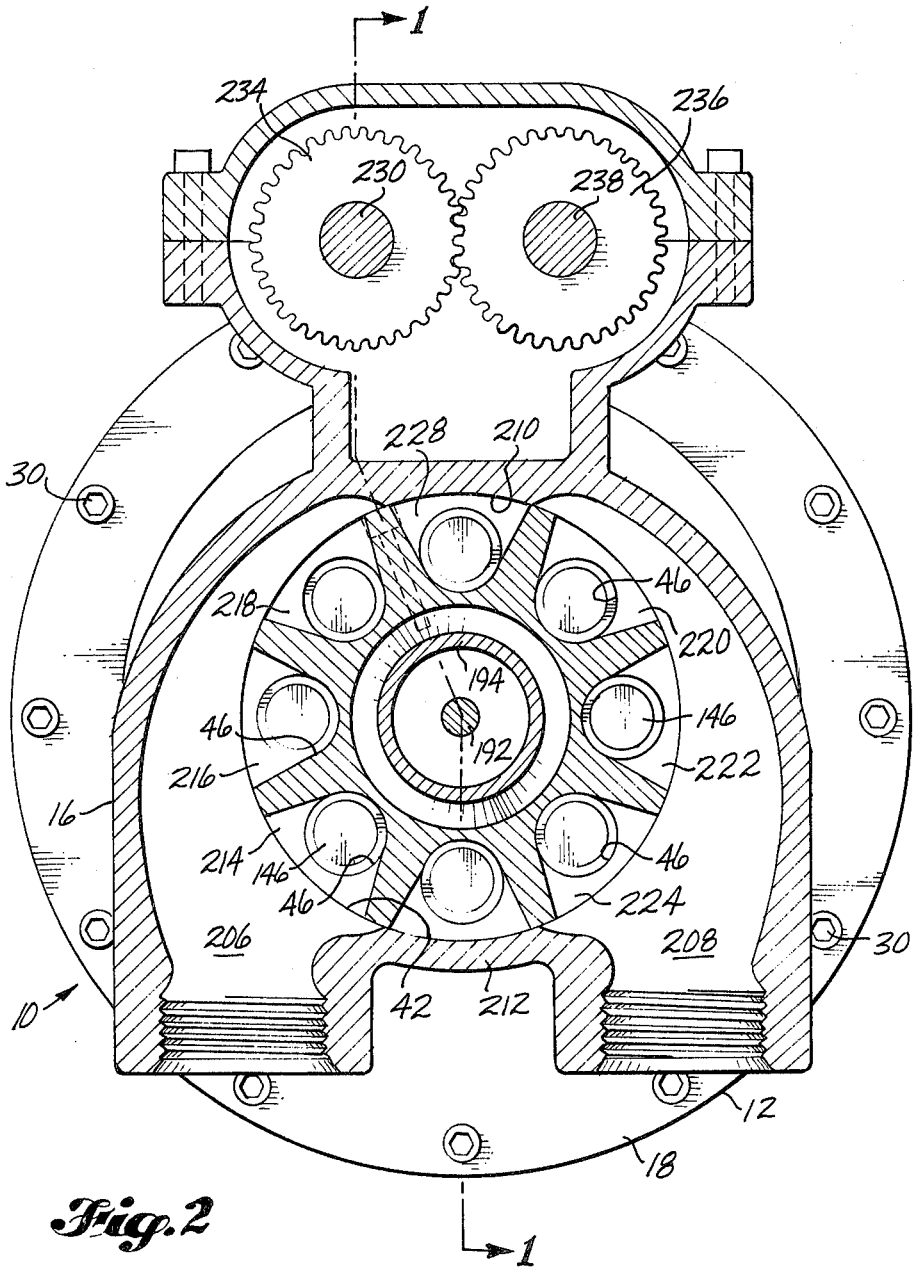
FIG. 2 is a sectional view taken substantially along the line 2—2 of FIG. 1.

Referring to FIG. 2, the center section 16 of housing 10 is formed to include a pair of scrolls 206, 208, one of which serves as an inlet and the other which serves as an outlet. As shown by FIG. 2, the scrolls 206, 208 are separated by lands 210, 212.

Let it be assumed, for example, that the mechanism is functioning as a hydraulic motor and scroll 206 is the inlet. High pressure hydraulic fluid communicating with scroll 206 enters through openings 214, 216, 218 into the central regions of three of the cylinders bores 46. An opposite set of cylinder bores 46 communicate via openings 220, 222, 224 with the outlet scroll 208. The lands 210, 212 block off the inlet/outlet openings 206, 208 of the cylinder bores 46 which are in register with the lands 210, 212. The lands 210, 212 prevent direct flow between scrolls 206, 208, and block flow in or out of each cylinder 46, at the position that relative motion of pistons within that cylinder reverses, and flow in or out of that cylinder is at a null.

The mechanism, so far as it has been described, could be characterized as consisting of two fixed displacement axial pumps/motors on opposite sides of a common cylinder block 44. In accordance with the present invention, the mechanism becomes a variable displacement fluid pump/motor by virtue of the fact that the two bearing supports 48, 50 are rotatable in position relative to each other.

In the position shown by FIG. 1, the two support planes for the piston drive rings 58, 68 provide a maximum axial spacing between the two piston drive rings 58, 68 at the bottom of the mechanism, and a minimum spacing at the top of the mechanism. In this position, the supports are mirror images of each other. Rotation of the two bearing supports 48, 50 in opposite directions results in both a shortening of the axial spacing at the bottom of the mechanism and a lengthening of the axial spacing at the top of the mechanism. When the angled bearing supports are positioned ninety degrees in opposite directions from the position shown in FIG. 1, the axial spacing between the two bearings supports 58, 50 at each cylinder bore would be the same and rotation of the piston drive rings 58, 68 and the cylinder block would produce no relative motion, (or fluid displacement) between the two pistons in each cylinder bore.

If the angled bearing supports 48, 50 are repositioned further beyond 90 degrees from the position illustrated in FIG. 1, displacement would increase, but flow would be in the opposite directions.

In the illustrated embodiments, (FIGS. 1 and 5), the mechanism for rotating the two bearing supports 48, 50 in position comprises a pair of gear shafts 230, 238 which are shown journaled for rotation at the top of the housing 10. Shafts 230 and 238 may be constructed in sections, coupled together by spline connections, as shown. Shaft 230 carries a positioning gear 232 which is in mesh with the ring gear 158 for bearing support 48. It also includes a control gear 234 which meshes with a like control gear 236 carried by the second shaft 238. A gear 240, identical to gear 232, is connected to shaft 238 and it meshes with the ring gear 158 that is connected with bearing support 50.

In the illustrated embodiments, shaft 238 is provided with an input portion 242 to which a torque is applied for causing a rotatable adjustment in position of the two bearing supports 48, 50. When shaft 238 is rotated, it directly applies a rotational drive to the bearing support 50, in the direction opposite the rotation of shaft 238. Through gears 234, 236 it also rotates shaft 230 in the direction opposite the rotation of shaft 238. Rotation of shaft 230, and the drive provided by gear 232 and the ring gear 158 connected to bearing support 48, causes bearing support 48 to rotate in the direction opposite the rotation of bearing support 50. Drive gears 240, 232 are identical. The two control gears 234, 236, are identical. The ring gears 158 for both bearing supports 48, 50, are identical. This arrangement results in an equal amount of rotation of each bearing support 48, 50, but in the opposite direction.

Figure 4:
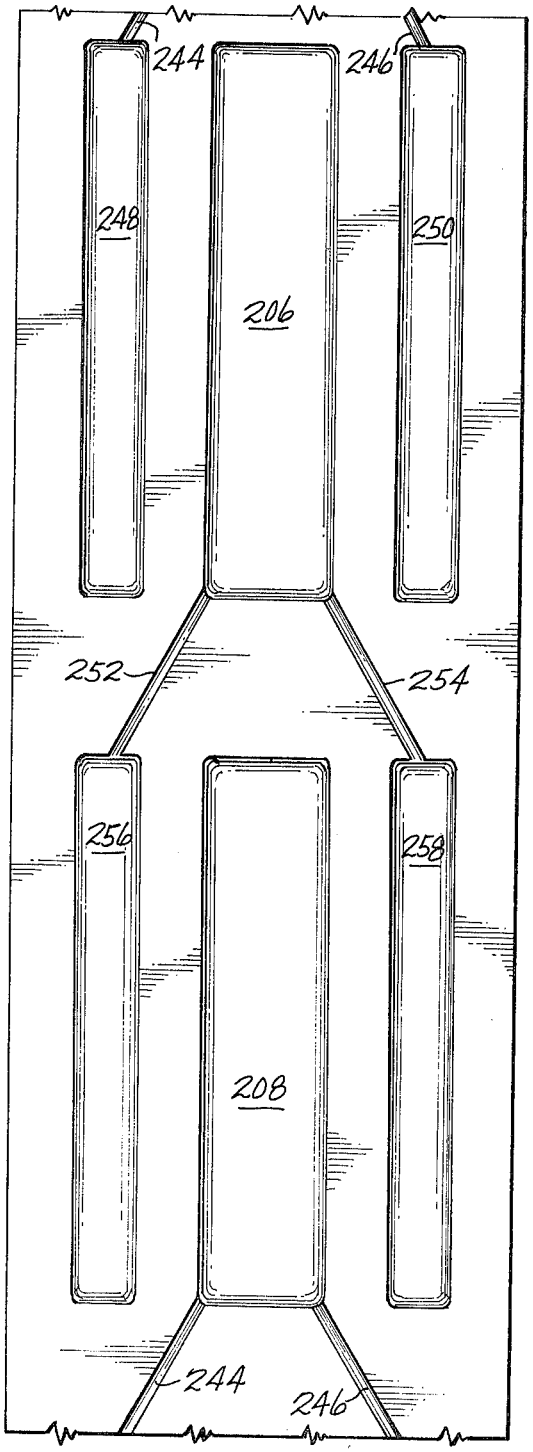
FIG. 4 is a view of the inner surface of the bore in which the cylinder block rotates, as it would appear if laid out flat.

FIG. 4 shows the inside surface of the bore 42 as it would appear if it were to be laid out flat. Preferably, scroll 208 is connected via passageways 244, 246 to a pair of pressure balancing cavities 248, 250 which are located axially outwardly of the scroll 206. In similar fashion, passageways 252, 254 connect scroll 206 to a pair of pressure balancing cavities 256, 258 which are spaced axially outwardly from scroll 208. Each of the cavities 248, 250, 256, 258 is about one eighth of an inch deep or less, and has a circumferential length which is substantially identical to the circumferential length of the cavities of the scrolls 206, 208.

The function of pressure balancing cavities 248, 250, 256, 258 is to essentially balance the forces acting on the cylinder block. The surface area of each scroll 206, 208 is substantially equal to the surface area of two of the pressure balance cavities 248, 250, 256, 258. Thus, referring to FIG. 3, if scroll 206 is in communication with a high pressure, the pressure balance cavities 256, 258 on the opposite side of the cylinder block 44 are also in communication with the high pressure. Since the combined areas of cavities 256, 258 substantially equals the area of scroll opening 206, the forces on the cylinder block 44 are substantially balanced diametrically. In this example, scroll 208 would be in communication with a low pressure and the pressure balance cavities 248, 250 with which it is connected will also be at substantially the same low pressure. Hence, these regions will essentially transmit no net forces to the cylinder block.

FIGS. 5—9 relate to a modified embodiment of the invention which is essentially like the mechanism that has been described above in connection with FIGS. 1—4, except for a change in the apparatus for connecting the several rotating components together. For this reason, only the changes will be described. The reference numerals used in FIGS. 1—4 will be used in FIGS. 5—9 for denoting the components which have not been changed.

Figure 5:
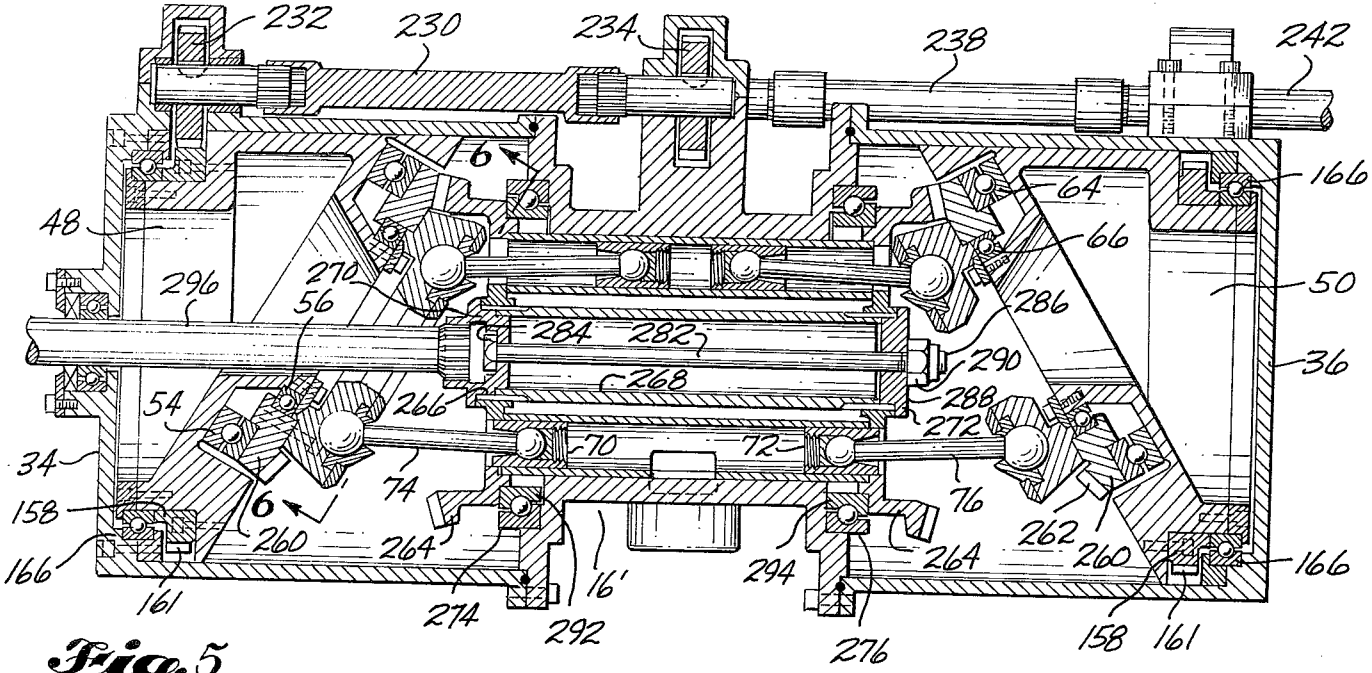
FIG. 5 is a view like FIG. 1, but of a modified form of the invention.
Figure 6:
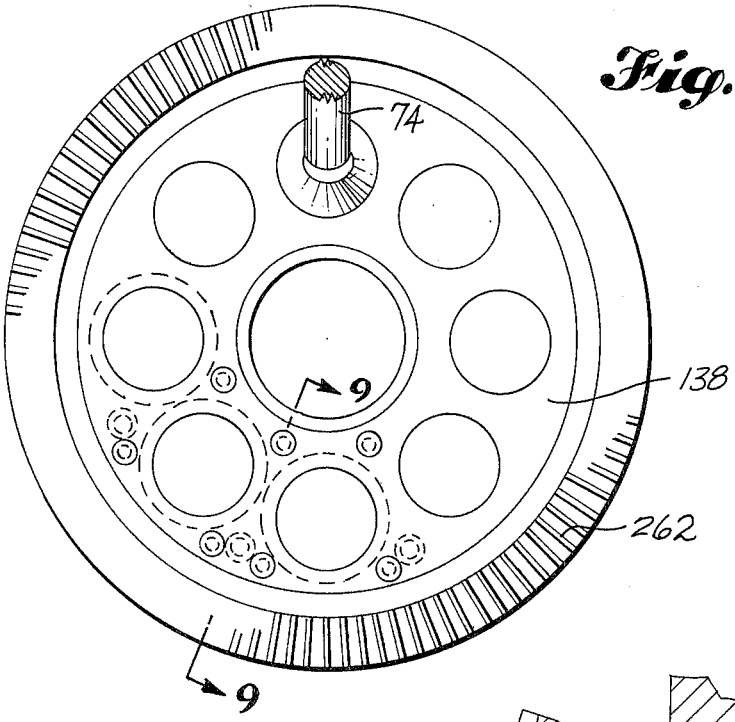
FIG. 6 is a sectional view taken substantially along line 6—6 of FIG. 5.

Referring to FIG. 5, each bearing ring 260 carries a bevel gear 262. In other respects, the ring 260 is functionally equivalent to bearing ring 84. The bevel gears 262 mesh with bevel gears 264 which are spline connected at 266 to drive shaft section 268 and retainer elements 270, 272. Gears 264 are mounted for rotation by means of combination bearings 274, 276, the fixed races of which are snugly received within end cavities formed in the end portions of housing section 16'. A tension rod 282, in the nature of a bolt having a head 284 at one of its ends and a threaded portion 286 at its opposite end, extends between and interconnects the two elements 270, 272. Head 284 bears against a radial wall portion of member 270. A nut 290, is screwed onto threaded portion 286 and bears against the outer end surface 288 of member 272. When tightened, nut 290 draws the two members 270, 272 together. They, in turn, exert axially inwardly directed forces on the gears 264, bringing them into tight engagement with the rotating races 292, 294 of the bearings 274, 276.

Fitting 270 is spline connected to a shaft section 296 which extends outwardly of the housing.

Figure 7:
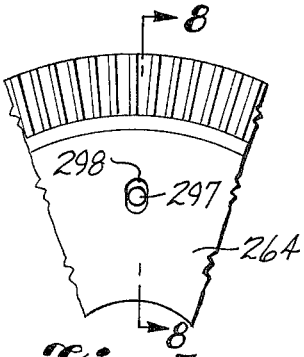
FIG. 7 is a fragmentary elevational view looking towards a bevel gear, showing a radially elongated drive slot formed in the gear and a drive pin engaged within the drive slot.
Figure 8:
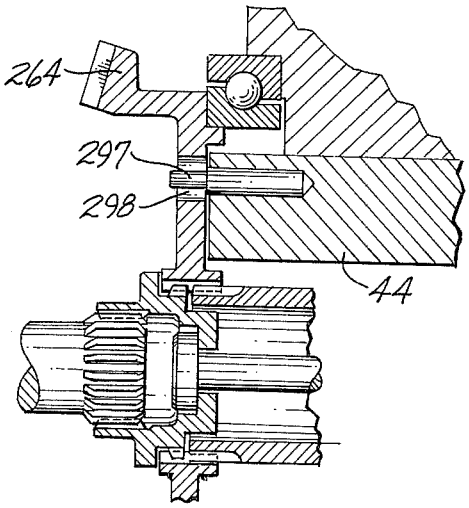
FIG. 8 is a fragmentary sectional view taken substantially along line 8—8 of FIG. 7.
Figure 9:
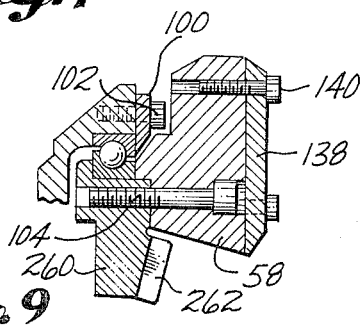
FIG. 9 is a sectional view taken substantially along line 9—9 of FIG. 6, showing a manner of connecting the bevel gear to the piston drive ring.

As shown by FIGS. 7 and 8, in this embodiment, the cylinder block 44 is driven by one or more drive pins 297 carried by the block 44, each of which protrudes into a radial slot 298 cut within one of the gears 264.

Referring to FIG. 3, in each embodiment, each ball member 130 is mounted onto a tubular stud 300 which is threaded at its inner end into a socket 302 formed in the end of the rod 74, 76. The ball 138 at the piston end of the rod is mounted in a similar fashion. The plug member 146, the outer socket member 144, the ball member 138, the stud 300, the connector rod 74, 76, the stud 304 and the ball member 130 may all include passageways which are in alignment with each other and which function to communicate hydraulic fluid from the cylinder bore to the socket carried by the piston drive ring 58, 68, for lubricating the ball and socket connection. Fluid leakage occurs from each cylinder bore 46 into the ball and socket connection between the piston rod and the piston to provide lubrication at such connection.

In both embodiments, the high torque loads are isolated from the cylinder block 44. The cylinder block 44, in effect, "floats" relative to the load transferring components.

The fact that the piston drive rings are supported at a fixed angle simplifies the construction of the connections between the outer ends of the piston rods and the piston drive rings. Such connections do not have to accommodate angle changes and can therefore easily be constructed for applying pulling forces on the connector rods. Also, the transfer of reaction forces from the moving parts to the housing is simplified. There are no pin connections, as in the case of swash plates, which have to carry the reaction forces. The transfer of reaction forces is directly made to the bearing support members and from the bearing support members directly to the housing, via rugged bearings. This construction adds stiffness to the system and makes the mechanism very rugged and solid.

In both embodiments, the centers of rotation of the ball members 130 lie on circles which are slightly larger in diameter than the circle on which the centers of the cylinder bores 46 are situated. This results in the axis of the connector rods deviating only a small amount from a true axial line. The benefit gained by this arrangement is that essentially no side loads are applied on the pistons. The connector rods are always in substantially axial alignment with the cylinder bores.

The torque loads on the system, whether the mechanism be operated as a pump or a motor, are reacted on the bearing support members 48, 50 in the same angular direction. The control gears and shafts react these angular forces and allow only opposite rotation. As a result, the amount of torque needed to rotate the bearing support members to vary displacement, is relatively small. In addition, the positioning control mechanism functions to essentially balance the counteracting reaction torques.

Assuming that the embodiment shown by FIG. 1 is being operated as a pump, an input drive is applied to the system via the drive shaft 188, 190, 192. This drive is transmitted to the piston drive rings via the universal joints 108. The torque, and axial loads that are generated are directly reacted on the bearing support members 48, 50 and are transmitted to the housing via the bearings 166 and the position adjustment gear system. The cylinder block 44 is essentially isolated from the torque forces. It is necessary that it be rotated but the coupling mechanism transmits forces which are quite small and therefore the coupling mechanism may be quite simple and light weight.

Mechanism constructed in accordance with the present invention can be used to provide relatively cheap, variable power transmissions, for use in automobiles, farm equipment, and essentially any other system in which a power transmission might be used.

I claim:

1. A variable displacement pump/motor comprising:

a housing including an axial cylinder block bore;

an axially elongated cylinder block mounted for rotation within said bore about a longitudinal axis, said cylinder block having a first end and a second end and including a plurality of axial cylinder bores arranged in a ring surrounding the axis of rotation of the cylinder block;

two pistons disposed in each cylinder bore, for opposed reciprocation in the bore;

a first bearing support member within said housing, spaced axially outwardly from the first end of the cylinder block, and including an inner end portion which is set at a fixed oblique angle with respect to the axis or rotation of the cylinder block;

a second bearing support member within said housing, spaced axially outwardly from the second end of the cylinder block, and including an inner end portion which is set at a fixed oblique angle with respect to the axis or rotation of the cylinder block;

a first piston drive ring positioned within said housing on the first bearing support member;

first bearing means carried by the first bearing support member, mounting said first piston drive ring onto said first bearing support member, for rotation relative to the first bearing support member;

second bearing means carried by the second bearing support member, mounting said second piston drive ring onto said second bearing support member, for rotation relative to the second bearing support member;

a piston rod connected to each piston and extending generally axially outwardly from the cylinder bore in which its piston is situated, and at its outer end being connected to the piston drive ring at its end of the housing;

third bearing means within said housing mounting the first bearing support member for rotation about the axis or rotation of the cylinder block;

fourth bearing means within said housing mounting the second bearing support member for rotation about the axis or rotation of the cylinder block;

controllable positioning means for rotating the first and second bearing support members in opposite directions and holding them fixed relative to each other in a selected position;

drive shaft means connected to both piston drive rings;

inlet port means in said housing connecting with center portions of the cylinder bores on one side of the cylinder block;

outlet port means in said housing communicating with center portions of the cylinder bores on the diametrically opposite side of the cylinder block; and wherein the cylinder block includes an open center and wherein the drive shaft means includes a portion which extends axially through the open center of the cylinder block, a first universal joint connecting such shaft portion to the first piston drive ring, a second universal joint connecting said shaft portion to the second piston drive means, and a torque transmitting coupling interconnected between said shaft portion and the cylinder block.

2. A variable displacement pump/motor according to claim 1, wherein said torque transmitting connector comprises a generally conical member having a large diameter end which substantially matches the diameter of the center opening and the cylinder block and a small end which is spline connected to said shaft portion, and drive pin means connecting the cylinder block to the large diameter end of said member.

3. A variable displacement pump/motor according to claim 2, wherein the large diameter end of the member includes an outer ball surface in contact with the inner surface of the cylinder block.

4. A variable displacement pump/motor according to claim 2, wherein the pin connection comprises a pin member carried by the cylinder block having a radially inwardly projecting portion, and said member includes an elongated hole for receiving the inwardly projecting portion of the pin.

5. A variable displacement pump/motor comprising:

a housing including an axial cylinder block bore;

an axially elongated cylinder block mounted for rotation within said bore about a longitudinal axis, said cylinder block having a first end and a second end and including a plurality of axial cylinder bores arranged in a ring surrounding the axis of rotation of the cylinder block, and further including an open center;

two pistons disposed in each cylinder bore, for opposed reciprocation in the bore;

a first bearing support member within said housing, spaced axially outwardly from the first end of the cylinder block, and including an inner end portion which is set at a fixed oblique angle with respect to the axis or rotation of the cylinder block;

a second bearing support member within said housing, spaced axially outwardly from the second end of the cylinder block, and including an inner end portion which is set at a fixed oblique angle with respect to the axis or rotation of the cylinder block;

a first piston drive ring positioned within said housing on the first bearing support member;

first bearing means carried by the first bearing support member, mounting said first piston drive ring onto said first bearing support member, for rotation relative to the first bearing support member;

second bearing means carried by the second bearing support member, mounting said second piston drive ring onto said second bearing support member, for rotation relative to the second bearing support member;

a piston rod connected to each piston and extending generally axially outwardly from the cylinder bore in which its piston is situated, and at its outer end being connected to the piston drive ring at its end of the housing;

third bearing means within said housing mounting the first bearing support member for rotation about the axis or rotation of the cylinder block;

fourth bearing means within said housing mounting the second bearing support member for rotation about the axis or rotation of the cylinder block;

controllable positioning means for rotating the first and second bearing support members in opposite directions and holding them fixed relative to each other in a selected position;

drive shaft means connected to the cylinder block and to both piston drive rings;

inlet port means in said housing connecting with center portions of the cylinder bores on one side of the cylinder block; and outlet port means in said housing communicating with center portions of the cylinder bores on the diametrically opposite side of the cylinder block wherein each piston drive ring includes a bevel gear having teeth which are directed generally axially inwardly, and said pump/motor includes a torque transmitting shaft means extending from one bevel gear to the other through the open center of the cylinder block and interconnecting the two bevel gears and transfering drive load from one bevel gear to the other bevel gear apart from the cylinder block, so that the cylinder block is essentially isolated from such drive load.

6. A variable displacement pump/motor according to claim 5, comprising a gear connected to each end of the shaft means, each said gear having a bevel gear with axially outwardly projecting teeth which are in mesh with the teeth of the bevel gear carried by the piston drive ring at its end of the pump/motor.

7. A variable displacement pump/motor, comprising:

a housing including an axial cylinder block bore;

an axially elongated cylinder block mounted for rotation within said bore about a longitudinal axis, said cylinder block having a first end and a second end and including a plurality of axial cylinder bores arranged in a ring surrounding the axis of rotation of the cylinder block, and further including an open center;

two pistons disposed in each cylinder bore, for opposed reciprocation in the bore;

a first bearing support member within said housing, spaced axially outwardly from the first end of the cylinder block, and including an inner end portion which is set at a fixed oblique angle with respect to the axis or rotation of the cylinder block;

a second bearing support member within said housing, spaced axially outwardly from the second end of the cylinder block, and including an inner end portion which is set at a fixed oblique angle with respect to the axis or rotation of the cylinder block;

a first piston drive ring positioned within said housing on the first bearing support member;

first bearing means carried by the first bearing support member, mounting said first piston drive ring onto said first bearing support member, for rotation relative to the first bearing support member;

second bearing means carried by the second bearing support member, mounting said second piston drive ring onto said second bearing support member, for rotation relative to the second bearing support member;

a piston rod connected to each piston and extending generally axially outwardly from the cylinder bore in which its piston is situated, and at its outer end being connected to the piston drive ring at its end of the housing;

drive shaft means connected to both piston drive rings and extending through the open center of the cylinder block and transmitting drive loads from one piston drive ring to the other, apart from the cylinder block, so that said cylinder block is isolated from the drive loads and is free to float and center itself;

inlet port means in said housing connecting with center portions of the cylinder bores on one side of the cylinder block; and outlet port means in said housing communicating with center portions of the cylinder bores on the diametrically opposite side of the cylinder block.

8. A variable displacement pump/motor according to claim 7, wherein said housing includes a pair of scrolls having ports which are in communication with diametrically opposed center portions of the cylinder block, wherein during use of the pump/motor, one of the said scrolls is in communication with a high pressure and the other is in communication with a low pressure, and wherein the housing includes pressure balance cavities adjacent each scroll port, presenting a substantially equal area to the cylinder block as the scroll port, and means for communicating the pressure balance cavity means that is adjacent the low pressure scroll with the high pressure scroll, and means for communicating the pressure balance cavity means which is adjacent the high pressure scroll with the low pressure scroll.

9. A variable displacement pump/motor according to claim 7, wherein the controllable positioning means comprises a ring gear on each bearing support member having radially outwardly directed teeth, and a system of gears and shafts interconnecting the ring gears and including a rotary input shaft, whereby rotation of the rotary input shaft will cause a counterrotation of the bearing support members.

10. A variable displacement pump/motor according to claim 9, wherein the third bearing means is positioned axially outwardly of the ring gear carried by the first bearing support member and the fourth bearing means is positioned axially outwardly of the ring gear carried by the second bearing support member, and wherein the third and fourth bearing means are combination bearings adapted for carrying both radial and axial loads.

11. A variable displacement pump/motor, comprising:

a housing including an axial cylinder block bore;

an axially elongated cylinder block mounted for rotation within said bore about a longitudinal axis, said cylinder block having a first end and a second end and including a plurality of axial cylinder bores arranged in a ring surrounding the axis of rotation of the cylinder block, and further including an open center;

two pistons disposed in each cylinder bore, for opposed reciprocation in the bore;

a first bearing support member within said housing, spaced axially outwardly from the first end of the cylinder block, and including an inner end portion which is set at a fixed oblique angle with respect to the axis or rotation of the cylinder block;

a second bearing support member within said housing, spaced axially outwardly from the second end of the cylinder block, and including an inner end portion which is set at a fixed oblique angle with respect to the axis or rotation of the cylinder block;

a first piston drive ring positioned within said housing on the first bearing support member;

first bearing means carried by the first bearing support member, mounting said first piston drive ring onto said first bearing support member, for rotation relative to the first bearing support member;

second bearing means carried by the second bearing support member, mounting said second piston drive ring onto said second bearing support member, for rotation relative to the second bearing support member;

a piston rod connected to each piston and extending generally axially outwardly from the cylinder bore in which its piston is situated, and at its outer end being connected to the piston drive ring at its end of the housing;

drive shaft means extending through the open center of the cylinder block and transmitting drive loads from one piston drive ring to the other, apart from the cylinder block, so that said cylinder block is isolated from the drive loads;

inlet port means in said housing connecting with center portions of the cylinder bores on one side of the cylinder block;

outlet port means in said housing communicating with center portions of the cylinder bores on the diametrically opposite side of the cylinder block;

third bearing means within said housing mounting the first bearing support member for rotation about the axis or rotation of the cylinder block; the fourth bearing means within said housing mounting the second bearing support member for rotation about the axis or rotation of the cylinder block; and controlable positioning means for rotating the first and second bearing support members in opposite directions and holding them fixed relative to each other in a selected position.

* * * * *